US010437187B2

(12) United States Patent
Hara et al.

(10) Patent No.: US 10,437,187 B2
(45) Date of Patent: Oct. 8, 2019

(54) FIXING DEVICE AND IMAGE FORMING APPARATUS

(71) Applicant: FUJI XEROX CO., LTD., Tokyo (JP)

(72) Inventors: Toko Hara, Kanagawa (JP); Motoharu Nakao, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/114,259

(22) Filed: Aug. 28, 2018

(65) Prior Publication Data

US 2019/0179243 A1 Jun. 13, 2019

(30) Foreign Application Priority Data

Dec. 7, 2017 (JP) ..... 2017-235485

(51) Int. Cl.
*G03G 15/20* (2006.01)
*G03G 15/00* (2006.01)

(52) U.S. Cl.
CPC ..... *G03G 15/2053* (2013.01); *G03G 15/2028* (2013.01); *G03G 15/2064* (2013.01); *G03G 15/602* (2013.01)

(58) Field of Classification Search
CPC ..... G03G 15/2053; G03G 15/2028; G03G 15/2064; G03G 15/2025
See application file for complete search history.

(56) References Cited

U.S. PATENT DOCUMENTS

| | | | | |
|---|---|---|---|---|
| 6,518,546 | B2 * | 2/2003 | Otsuka | G03G 15/2053 219/216 |
| 7,027,763 | B2 | 4/2006 | Kato et al. | |
| 8,750,775 | B2 * | 6/2014 | Ishida | G03G 15/2053 399/329 |
| 2011/0158716 | A1 * | 6/2011 | Fujiwara | G03G 15/2053 399/329 |
| 2017/0160684 | A1 * | 6/2017 | Zhang | G03G 15/2053 |

FOREIGN PATENT DOCUMENTS

| | | |
|---|---|---|
| JP | 2004-184814 | 7/2004 |
| JP | 2005-242113 | 9/2005 |
| JP | 2008-76589 | 4/2008 |
| JP | 4532933 | 8/2010 |

* cited by examiner

*Primary Examiner* — Sandra Brase
(74) *Attorney, Agent, or Firm* — JCIPRNET

(57) ABSTRACT

A fixing device includes a rotatable fixing belt; a contact portion that comes into contact with an inner peripheral surface of the fixing belt in a width direction; a holding portion disposed opposite the inner peripheral surface to guide and hold the fixing belt; a pressing unit that presses the fixing belt against the contact portion; a protrusion disposed at a portion of the holding portion upstream of the contact portion in a rotation direction of the fixing belt to come into contact with the inner peripheral surface in the width direction; a gap forming portion that forms a gap at a portion of the holding portion between the protrusion and the contact portion, the gap extending in the width direction of the fixing belt without allowing the fixing belt to come into contact with the holding portion; and a lubricant applied to the inner peripheral surface.

12 Claims, 14 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2017-235485 filed Dec. 7, 2017.

BACKGROUND

Technical Field

The present invention relates to a fixing device and an image forming apparatus.

SUMMARY

According to an aspect of the invention, a fixing device includes a rotatable fixing belt; a contact portion that comes into contact with an inner peripheral surface of the fixing belt in a width direction; a holding portion disposed opposite the inner peripheral surface of the fixing belt to guide and hold the fixing belt; a pressing unit that presses the fixing belt against the contact portion; a protrusion disposed at a portion of the holding portion upstream of the contact portion in a rotation direction of the fixing belt to come into contact with the inner peripheral surface of the fixing belt in the width direction; a gap forming portion that forms a gap at a portion of the holding portion between the protrusion and the contact portion, the gap extending in the width direction of the fixing belt without allowing the fixing belt to come into contact with the holding portion; and a lubricant applied to the inner peripheral surface of the fixing belt. A space defined by at least the fixing belt, the protrusion, and the gap forming portion has a vertical sectional area greater at a center portion than at an end portion in the width direction of the fixing belt.

BRIEF DESCRIPTION OF THE DRAWINGS

Exemplary embodiments of the present invention will be described in detail based on the following figures, wherein.

DETAILED DESCRIPTION

Exemplary embodiments of the present invention are described below with reference to the attached drawings.

First Exemplary Embodiment

Figure 1:
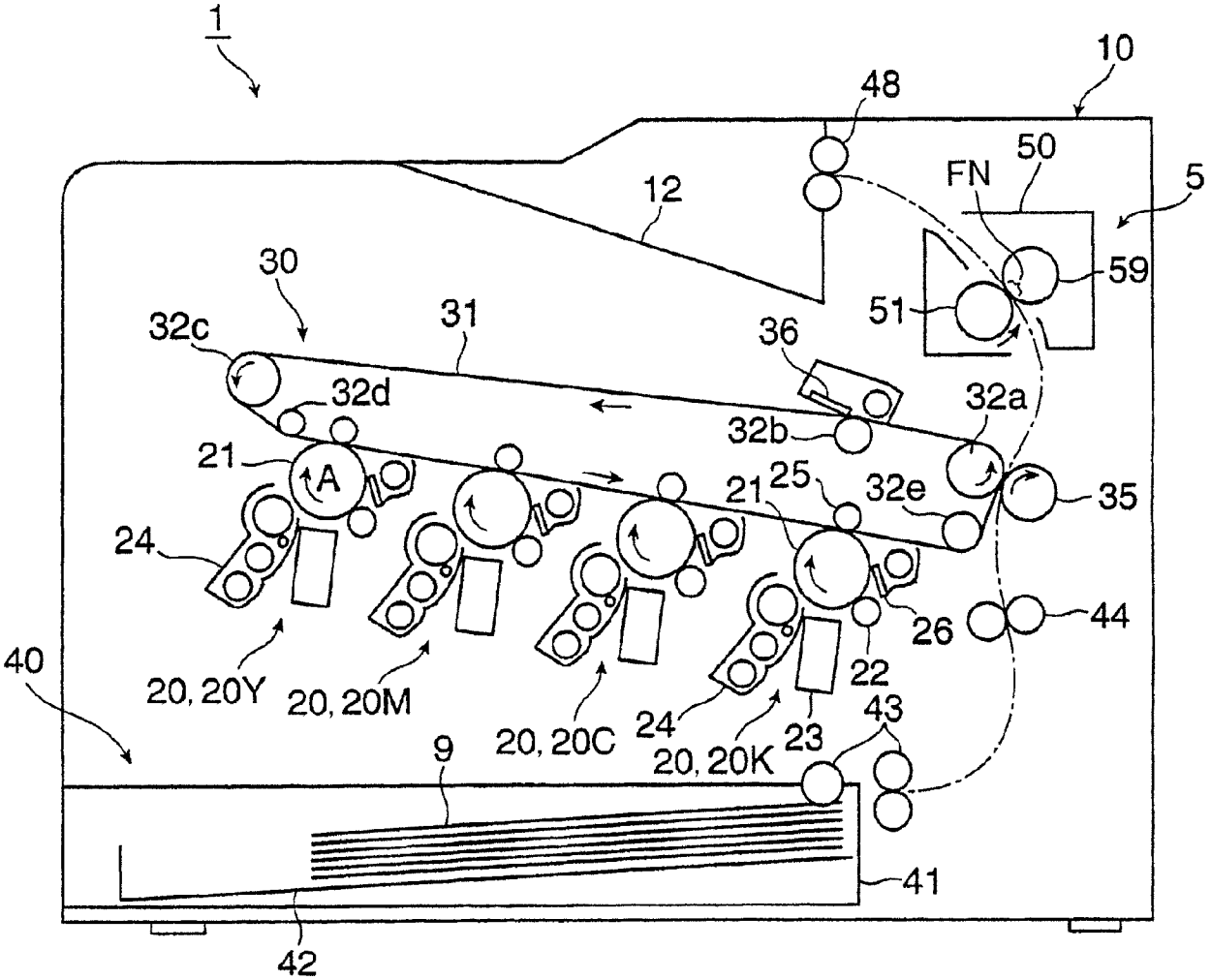
FIG. 1 is a schematic diagram of the entire structure of an image forming apparatus according to a first exemplary embodiment.
Figure 2:
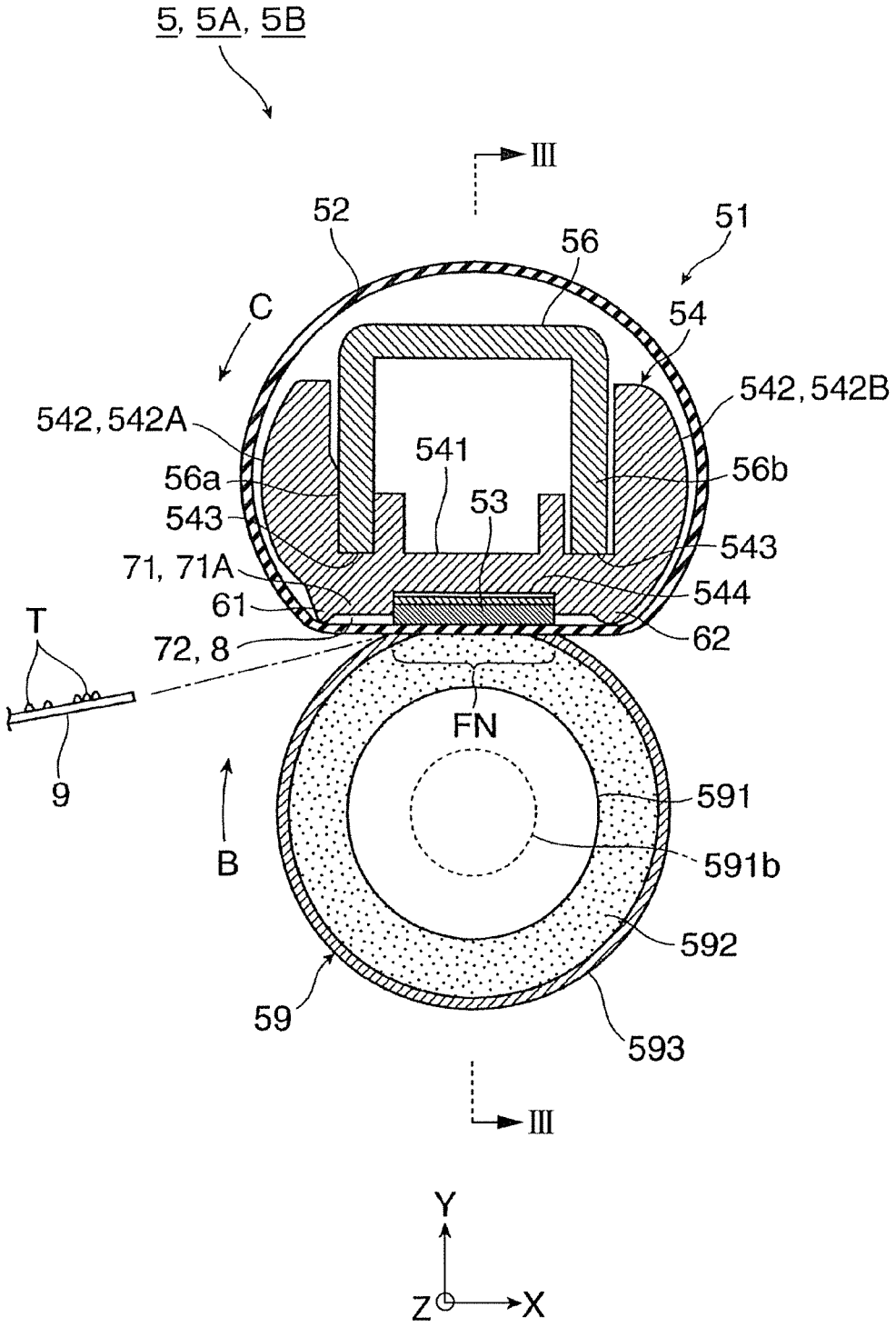
FIG. 2 is a partial sectional view of a related portion of the fixing device according to the first exemplary embodiment.

FIG. 1 and FIG. 2 illustrate an image forming apparatus including a fixing device according to a first exemplary embodiment. FIG. 1 schematically illustrates the entire structure of the image forming apparatus, and FIG. 2 schematically illustrates the structure of a related portion of the fixing device. Arrows denoted with X, Y, and Z in FIG. 2 and subsequent drawings serve as rectangular coordinate axes (and the directions of the axes) respectively indicating the directions of the width, height, and depth of a three-dimensional space assumed in each drawing. A circle of the rectangular coordinate axes illustrated in FIG. 2 denotes that arrow Z indicating the depth direction is directed perpendicularly downward of the plane of FIG. 2.

Entire Structure of Image Forming Apparatus

An image forming apparatus 1 forms an image with a developer on a recording sheet 9, which is an example of a recording medium. The image forming apparatus 1 is, for example, a printer that forms images corresponding to image information acquired from an external device such as an information terminal.

The image forming apparatus 1 includes a housing 10, the entire of which has a box-shaped appearance. As illustrated in FIG. 1, the image forming apparatus 1 includes, in the internal space of the housing 10, components such as image forming units 20, an intermediate transfer device 30, a sheet feeder 40, and a fixing device 5.

A discharged sheet receiving portion 12 is disposed on the upper surface of the housing 10 to allow discharged recording sheets 9 subjected to image formation to be stacked one on another thereon. The dot-dash line in FIG. 1 indicates a rough transport route of the recording sheets 9.

The image forming units 20 are units for forming toner images with toner serving as a developer.

The image forming units 20 according to the first exemplary embodiment are four image forming units 20Y, 20M, 20C, and 20K individually forming developer (toner) images of four colors of yellow (Y), magenta (M), cyan (C), and black (K).

These four image forming units 20 (Y, M, C, and K) each include a photoconductor drum 21, which is a drum-shaped photoconductor that rotates in the direction indicated with arrow A. The following devices are disposed around the photoconductor drum 21. Specifically, in each image forming unit 20 (Y, M, C, or K), devices such as a charging device 22, an exposure device 23, a developing device 24, a first transfer device 25, and a drum cleaner 26 are disposed around the photoconductor drum 21. In FIG. 1, all the components around only the image forming unit 20K for black (K) are denoted with the reference signs 21 to 26. The components around the image forming units 20 for other colors (Y, M, and C) may be or may not be denoted with the reference signs.

The charging device 22 is a device that charges the outer peripheral surface of the corresponding photoconductor drum 21, serving as an image formation area, to a predetermined potential, and includes, for example, a charging member such as a roller that comes into contact with the outer surface of the photoconductor drum 21. The exposure device 23 is a device that irradiates the charged outer peripheral surface of the photoconductor drum 21 with light decomposed into various color components on the basis of predetermined image information to form an electrostatic latent image of a corresponding one of the various color components. The exposure device 23 is connected to a device such as an image processor, not illustrated. The developing device 24 is a device that develops the electrostatic latent image with toner composed of a corresponding one of the various color components to render the image visible as a toner image of the corresponding color (Y, M, C, or K).

The first transfer device 25 is a device that first-transfers the toner image on the corresponding photoconductor drum 21 to the intermediate transfer device 30 (or an intermediate transfer belt 31 of the intermediate transfer device 30). The first transfer device 25 includes, for example, a transfer member such as a roller that comes into contact with the outer surface of the photoconductor drum 21 with the intermediate transfer belt 31, described below, interposed therebetween. As described below, the first transfer device 25 constitutes part of the intermediate transfer device 30. The drum cleaner 26 is a device that removes unnecessary objects such as toner remaining on the outer peripheral surface of the corresponding photoconductor drum 21 subjected to first transfer to clean the outer peripheral surface. The drum cleaner 26 includes, for example, a cleaning member such as a blade and a recovering portion.

Each image forming unit 20 (Y, M, C, or K) operates in the following manner when a controller, not illustrated, receives an image formation command from, for example, an external connection terminal or an operation unit on the image forming apparatus.

First, each photoconductor drum 21 starts rotating, the corresponding charging device 22 charges the outer peripheral surface of the photoconductor drum 21 to a predetermined potential, and then the corresponding exposure device 23 irradiates the charged outer peripheral surface of the photoconductor drum 21 with light corresponding to an image signal of the corresponding color component to form an electrostatic latent image of the corresponding color component.

Subsequently, in each image forming unit 20 (Y, M, C, or K), the developing device 24 (Y, M, C, or K) develops the electrostatic latent image of the color component on the outer peripheral surface of the photoconductor drum 21 with toner of one of the four colors (Y, M, C, and K) corresponding to the color component. Thus, a toner image of one of the four colors is formed on the photoconductor drum 21 of the corresponding image forming unit 20 (Y, M, C, or K). For example, a toner image of yellow (Y) is formed on the photoconductor drum 21 of the image forming unit 20Y.

Subsequently, the toner image of the corresponding color formed on the photoconductor drum 21 of the corresponding image forming unit 20 (Y, M, C, or K) is transported to a first transfer portion, at which the corresponding first transfer device 25 faces the intermediate transfer device 30 (intermediate transfer belt 31 of the intermediate transfer device 30), and first-transferred at the first transfer portion. The first transfer is described below. The photoconductor drum 21 subjected to first transfer is cleaned by the corresponding drum cleaner 26 to be ready for the next image formation.

The intermediate transfer device 30 is a device that allows the toner image formed by each image forming unit 20 to be first-transferred thereto, holds and transports the toner image, and finally second-transfers the toner image to the recording sheet 9.

The intermediate transfer device 30 includes an endless intermediate transfer belt 31 that holds the toner image transferred thereto from the photoconductor drums 21 of the image forming units 20 (Y, M, C, and K). The following devices are disposed around the intermediate transfer belt 31.

The intermediate transfer belt 31 is supported by multiple support rollers 32*a* to 32*e* to rotate (rotationally move) to sequentially pass the first transfer portions of the image forming units 20 (Y, M, C, and K). The support roller 32*a* serves as a driving roller and a second-transfer backup roller.

On the other hand, the first transfer devices 25 of the respective image forming units 20 (Y, M, C, and K) are disposed on the inner side of the intermediate transfer belt 31. A second transfer device 35 is disposed on the outer peripheral surface of the portion of the intermediate transfer belt 31 supported by the support roller 32*a*. The second transfer device 35 includes a second transfer member such as a roller that allows the recording sheet 9 to pass thereby to second-transfer the toner image on the intermediate transfer belt 31 to the recording sheet 9. A belt cleaner 36 is disposed at a portion on the outside of the intermediate transfer belt 31. The belt cleaner 36 removes unnecessary objects such as toner remaining on the outer peripheral surface of the intermediate transfer belt 31 subjected to second transfer to clean the outer peripheral surface.

The sheet feeder 40 is a device that houses recording sheets 9 and feeds the recording sheets 9 to a second transfer position at which the intermediate transfer device 30 performs second transfer.

The sheet feeder 40 includes a sheet container 41 and a pickup device 43. The sheet container 41 is removably attached to the housing 10 and houses the recording sheets 9 of an intended size or type while allowing the recording sheets 9 to be stacked on a sheet receiving plate 42. The pickup device 43 feeds the recording sheets 9 one by one from the sheet container 41.

The sheet feeder 40 feeds appropriate recording sheets 9 one by one from the sheet container 41 using the pickup device 43 during image formation. Each recording sheet 9 fed from the sheet feeder 40 moves forward along the transport route indicated with the dot-dash line, and is finally fed to the second transfer position (position between the intermediate transfer belt 31 and the second transfer device 35) of the intermediate transfer device 30 at the second transfer timing by a pair of transport timing adjustment rollers 44 disposed on the transport route.

The intermediate transfer device 30 sequentially first-transfers the toner images of different colors on the photoconductor drums 21 of the image forming units 20 (Y, M, C, and K) to the outer peripheral surface of the intermediate transfer belt 31 rotating in the direction indicated with arrows, while the toner images are superposed through the transfer operations of the respective first transfer devices 25.

Subsequently, the intermediate transfer device 30 holds the first-transferred toner images on the outer peripheral surface of the rotating intermediate transfer belt 31, and transports the toner images to the second transfer position facing the second transfer device 35. Thereafter, the intermediate transfer device 30 second-transfers the toner images to the recording sheet 9 fed to the second transfer position along the transport route from the sheet feeder 40 with the transfer operation of the second transfer device 35. The outer peripheral surface of the intermediate transfer belt 31 after the second transfer is cleaned by the belt cleaner 36 to be ready for the next image formation.

The fixing device 5 is a device that fixes, to the recording sheet 9, an unfixed toner image second-transferred to the recording sheet 9 by the intermediate transfer device 30.

The fixing device 5 includes, inside a box-shaped housing 50, components such as a fixing belt unit 51 and a pressing roller 59. The fixing belt unit 51 has a heating function. The pressing roller 59 forms an image fixing portion (fixing nip) FN that allows the recording sheet 9 to pass therethrough while pressing the recording sheet 9 against the fixing belt unit 51 to fix (perform heating and pressing on) the toner image to the recording sheet 9. The fixing device 5 is described in detail, below.

In the fixing device 5, when the recording sheet 9 to which a toner image T (FIG. 2) has been second-transferred by the intermediate transfer device 30 moves forward along the transport route indicated with the dot-dash line in FIG. 1 and is introduced into the housing 50, the recording sheet 9 is fed to the image fixing portion FN between the fixing belt unit 51 and the pressing roller 59. At this time, in the fixing device 5, when the recording sheet 9 passes through the image fixing portion FN together with the toner image T, the recording sheet 9 is heated with pressure, so that the toner image T melts and is fixed to the recording sheet 9.

The recording sheet 9 subjected to fixing is discharged from the inside of the housing 50 of the fixing device 5, moves forward along the transport route indicated with the dot-dash line in FIG. 1, is discharged out of the housing 10 with a pair of discharging rollers 48 at the terminal portion of the transport route, and is finally received by the discharged sheet receiving portion 12.

With these operations, the basic operation of the image forming apparatus 1 for forming an image on one side of the recording sheet 9 is finished.

The image forming apparatus 1 is capable of forming a color image constituted of a combination of toner of all the four (Y, M, C, and K) colors or other multiple colors by selectively operating all the four image forming units 20 (Y, M, C, or K) or some other (at least two) image forming units. In addition, the image forming apparatus 1 is capable of forming a single color image, formed from toner of a single color such as black, by operating one of the four image forming units 20 (Y, M, C, or K).

Structure of Fixing Device

The fixing device 5 includes, inside the housing 50 illustrated in FIG. 1, components such as the above-described fixing belt unit 51 and the pressing roller 59, which is an example of a pressing unit.

Figure 3:
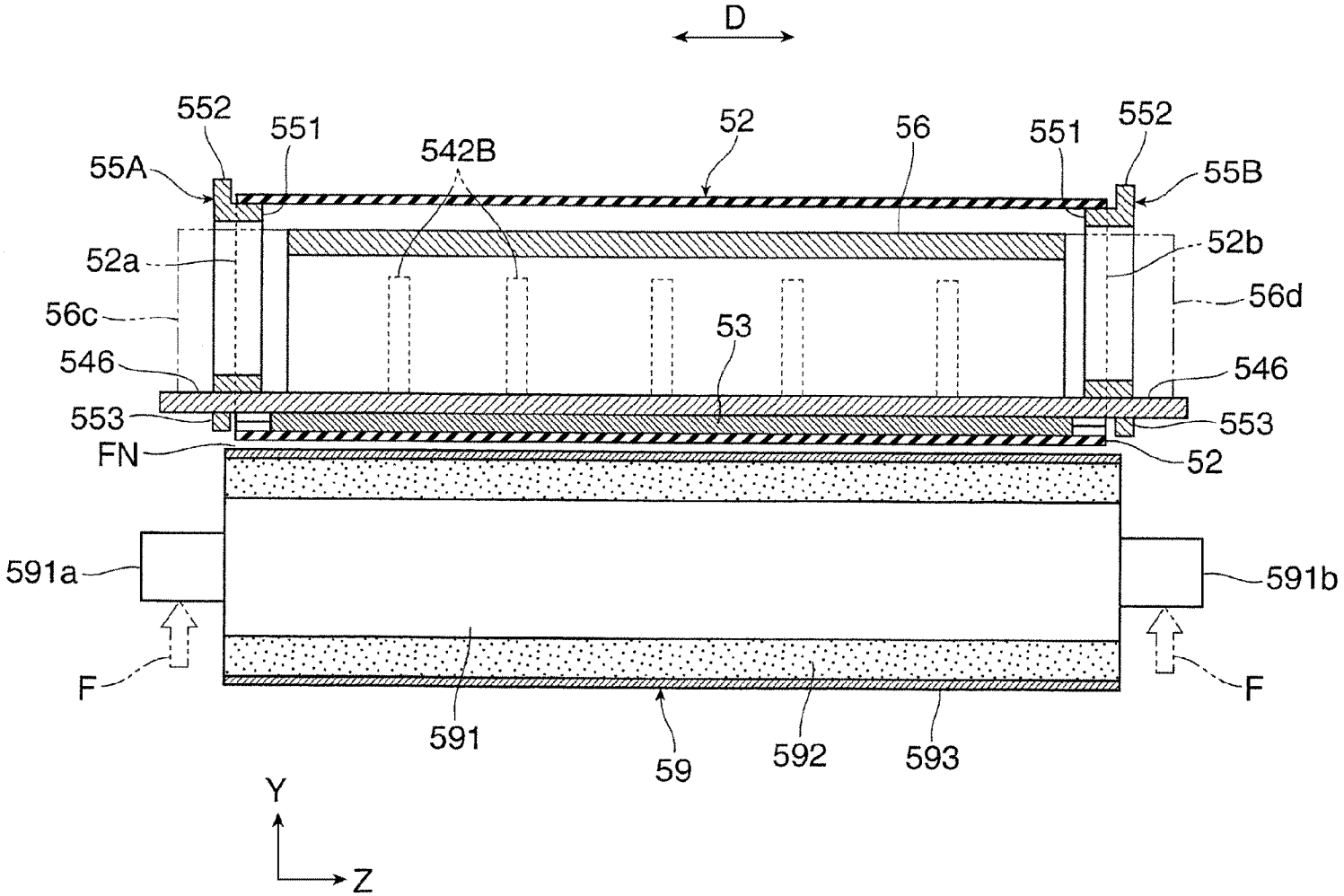
FIG. 3 is a schematic sectional view of the fixing device of FIG. 2 taken along line III-III.

As illustrated in, for example, FIG. 2 and FIG. 3, the fixing belt unit 51 includes a rotatable fixing belt 52, a heating member 53, which is an example of a contact portion that comes into contact with the inner peripheral surface of the fixing belt 52 in the width direction D, a guide holding member 54, which is an example of a holding portion disposed on the inner peripheral surface of the fixing belt 52 to guide and hold the fixing belt 52, and a pair of end supporting members 55A and 55B, which rotatably guide and support the ends of the fixing belt 52 from the inner peripheral surface of the fixing belt 52.

The pressing roller 59 includes a cylindrical roller core 591 made of a material such as metal, an elastic layer 592 disposed on the outer peripheral surface of the roller core 591 and made of a material such as rubber, and a surface layer 593 disposed on the outer peripheral surface of the elastic layer 592 and having releasability.

In the pressing roller 59, shafts 591*a* and 591*b* protruding from both ends of the roller core 591 are disposed at received portions, not illustrated, of the housing 50 to be rotatable with bearings, not illustrated, and movable toward and away from the heating member 53 of the fixing belt unit 51. In the pressing roller 59, the shafts 591*a* and 591*b* of the roller core 591 are pressed with a predetermined pressing force F by a pressing mechanism, not illustrated, against the heating member 53 with bearings and the fixing belt 52 of the fixing belt unit 51 interposed therebetween. When the rotating power is transmitted from a rotating drive device, not illustrated, to the shafts 591*a* and 591*b* of the roller core 591, the pressing roller 59 rotates at a predetermined speed in the direction indicated with arrow B.

In FIG. 3, for convenience of illustration of, for example, the position of the image fixing portion FN, the pressing roller 59 is illustrated slightly apart from the fixing belt 52 of the fixing belt unit 51.

The fixing belt 52 of the fixing belt unit 51 is a belt member formed into a cylinder having a width appropriate for fixing, a predetermined length, and a predetermined thickness.

The fixing belt 52 includes, for example, a belt base made of a material such as polyimide, and a release layer on the outer peripheral surface of the belt base. The fixing belt 52 is driven to rotate in the direction indicated with arrow C upon receipt of rotating power of the pressing roller 59 with which the fixing belt 52 comes into contact at the image fixing portion FN.

The heating member 53 of the fixing belt unit 51 is, for example, a member that includes a plane heater for heating the fixing belt 52.

The plane heater of the heating member 53 is a heating structure having a flat shape and a flat heating area. The plane heater has a predetermined thickness and a flat shape expanding in the rotation direction and the width direction of the fixing belt 52. The plane heater of the heating member 53 has its heating operation controlled by, for example, a power feeder, not illustrated, to have its temperature measured by a temperature sensor, not illustrated, to keep the temperature at a predetermined temperature. The plane heater of the heating member 53 is attached to, for example, a receiving portion, described below, of the guide holding member 54.

The guide holding member 54 of the fixing belt unit 51 includes a body 541 and belt guide portions 542. The body 541 is disposed in the width direction D of the fixing belt 52 at a position at which the image fixing portion FN is formed. The belt guide portions 542 are disposed on the body 541 to come into contact with and guide part of the inner peripheral surface of the fixing belt 52.

The body 541 is a substantially rectangular plate extending in the width direction D of the fixing belt 52.

The belt guide portions 542 include upstream guide portions 542A and downstream guide portions 542B. The upstream guide portions 542A are long-side end portions of the body 541 parallel to the width direction D of the fixing belt 52 and guide a portion of the fixing belt 52 in front of the image fixing portion FN. The downstream guide portions 542B are long-side end portions of the body 541 parallel to the width direction D of the fixing belt 52 and guide the fixing belt 52 after the fixing belt 52 passes through the image fixing portion FN. The upstream guide portions 542A and the downstream guide portions 542B are multiple separate guide portions spaced at predetermined intervals in the width direction D of the fixing belt 52.

At portions (on the first surface) of the body 541 of the guide holding member 54 facing away from the pressing roller 59, long-grooved receiving portions 543 into which portions of a support member 56 are fitted are disposed. The support member 56 supports the guide holding member 54 in the housing 50.

The support member 56 is a member having an angular C-shaped cross section formed by bending, for example, a plate extending in the width direction of the fixing belt 52 so that its long sides extending in the longitudinal direction face the image fixing portion FN. As illustrated in FIG. 3 with the two-dot chain lines, the support member 56 is a member having a length substantially the same length as that of the guide holding member 54 in the longitudinal direction.

The support member 56 has end portions 56*a* and 56*b* of the bent portions fitted into the receiving portions 543 on the second surface. The support member 56 has its both end portions 56*c* and 56*d* in the longitudinal direction fixed and attached to the receiving portions of the housing 50 of the fixing device 5. When the support member 56 is fixed, the fixing belt unit 51 including the guide holding member 54 has its position fixed to the housing 50.

On the other hand, at the portion (second surface) of the body 541 of the guide holding member 54 facing the pressing roller 59 (or the inner peripheral surface of the fixing belt 52), a receiving portion 544 to which the heating member 53 is attachable is disposed.

The receiving portion 544 is a portion recessed in a direction away from the pressing roller 59 and extending in the longitudinal direction of the body 541 to face the image fixing portion FN formed by the pressing roller 59. The plane heater of the heating member 53 is fixed and attached to the receiving portion 544.

Figure 4:
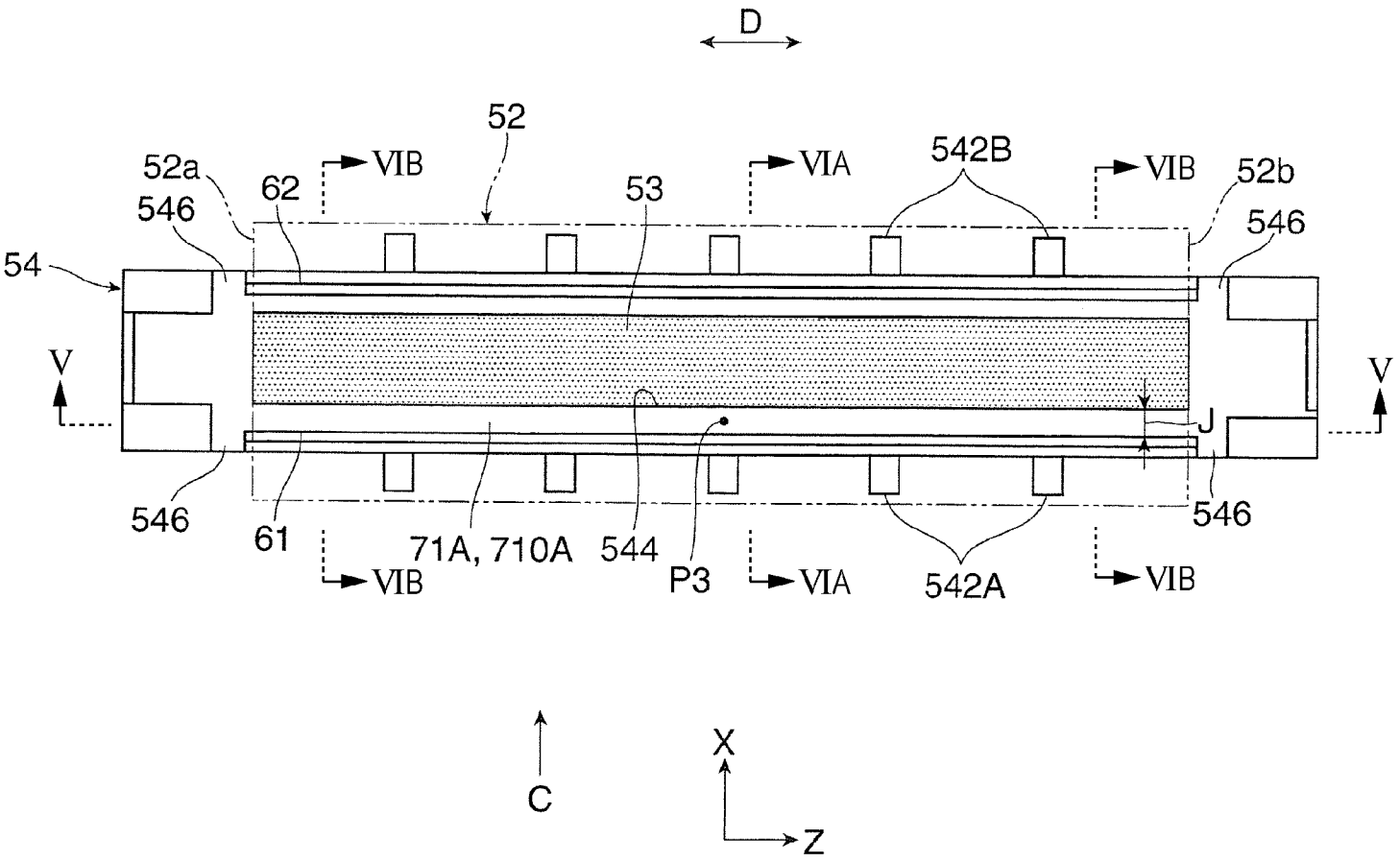
FIG. 4 is a schematic diagram of the structure of a portion (portion excluding a pressing roller viewed from the side on which the pressing roller is to be disposed) of the fixing device illustrated in FIG. 2.

As illustrated in, for example, FIG. 2 or FIG. 4, an upstream protrusion 61, serving as a first protrusion, is disposed on the second surface of the body 541 of the guide holding member 54 at the end portion upstream of the image fixing portion FN (heating member 53 or the receiving portion 544 of the heating member 53) in the rotation direction C of the fixing belt 52. A downstream protrusion 62, serving as a second protrusion, is disposed on the second surface of the body 541 at the end portion downstream of the image fixing portion FN in the rotation direction C of the fixing belt 52.

As illustrated in FIG. 2 and other drawings, both of the upstream protrusion 61 and the downstream protrusion 62 are protrusions protruding from the second surface of the body 541 toward the pressing roller 59. As illustrated in FIG. 4, the upstream protrusion 61 and the downstream protrusion 62 have a shape (protruding strip) that continues in the width direction D of the fixing belt 52 on the second surface of the body 541.

The upstream protrusion 61 and the downstream protrusion 62 are both disposed to come into contact with the inner peripheral surface of the fixing belt 52 in the width direction D. Thus, the fixing belt 52 is shaped to follow the shape of the protrusions 61 and 62 immediately before entering the image fixing portion FN and immediately after passing through the image fixing portion FN. When the fixing belt 52 is kept in this state, the recording sheet 9 introduced into and passing through the image fixing portion FN is less likely to be creased in the width direction D of the fixing belt 52.

As illustrated in, for example, FIG. 2 and FIG. 4, a gap forming portion 71 is disposed on the second surface of the body 541 of the guide holding member 54. The gap forming portion 71 forms a gap 72, in the width direction D of the fixing belt 52, with which the fixing belt 52 does not come into contact in an area between the upstream protrusion 61 and the heating member 53 serving as a contact portion.

The gap forming portion 71 is disposed between the upstream protrusion 61 and the heating member 53. The gap forming portion 71 has an opposing surface 710 that faces the inner peripheral surface of the fixing belt 52 without coming in contact with the surface and extends in the width direction D of the fixing belt 52.

Figure 5:
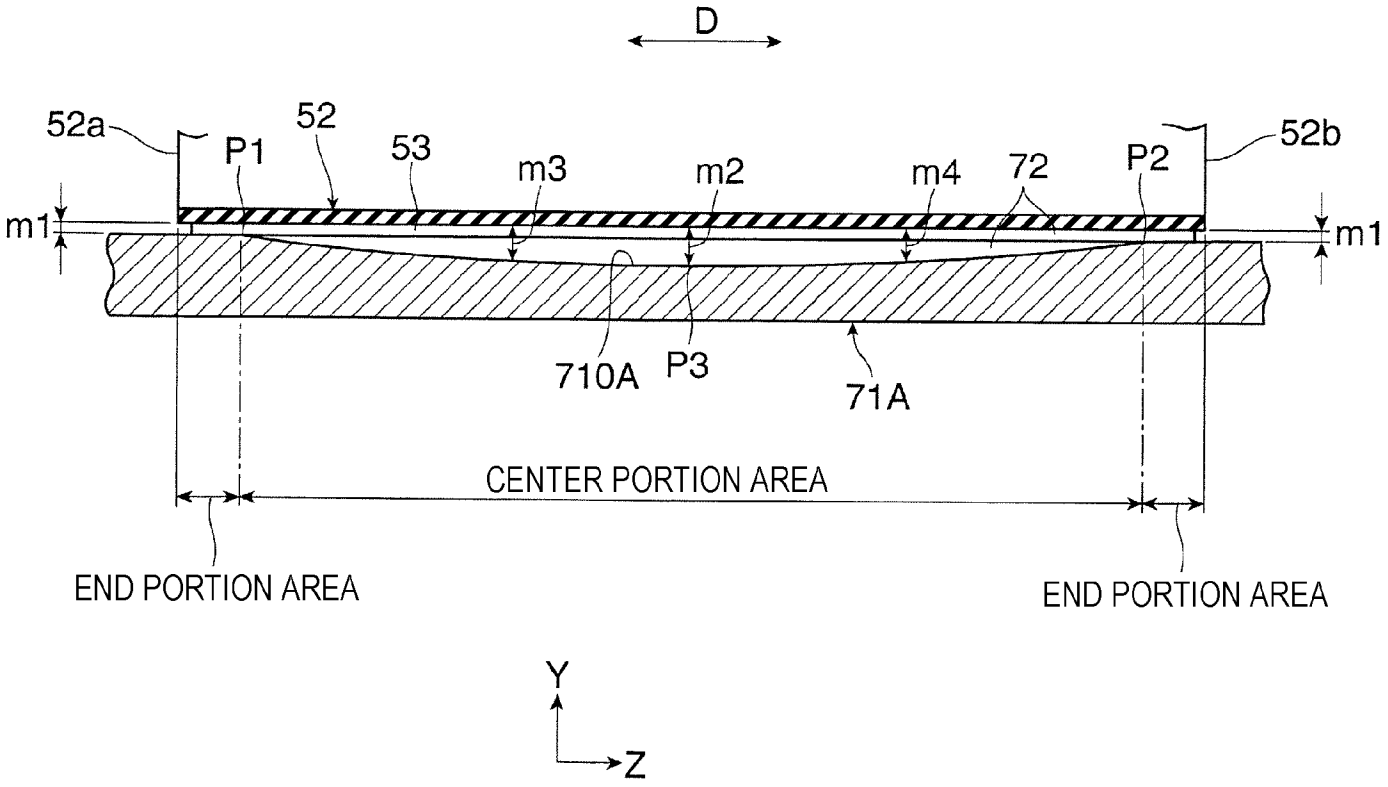
FIG. 5 is a schematic sectional view of a portion of the fixing device illustrated in FIG. 4 and other drawings, taken along line V-V.

As illustrated in FIG. 5, generally, the opposing surface 710 is a flat surface. A distance m by which the opposing surface 710 is spaced apart from the inner peripheral surface of the fixing belt 52 is a predetermined distance m1. The distance m1 of the opposing surface 710 is secured by, for example, adjusting the distance by which the opposing surface 710 is spaced apart from the peak of the upstream protrusion 61 and the distance by which the opposing surface 710 is spaced apart from the surface of the heating member 53 that comes into contact with the inner peripheral surface of the fixing belt 52. This opposing surface 710 may be formed by including a step between itself and the heating member 53.

As illustrated in, for example, FIG. 2 or FIG. 4, the gap 72 extending in the width direction D of the fixing belt 52 and with which the fixing belt 52 does not come into contact is disposed on the second surface of the body 541 of the guide holding member 54 between the downstream protrusion 62 and the heating member 53 serving as a contact portion.

As illustrated in FIG. 4, the body 541 of the guide holding member 54 has attachment surface portions 546 at the end portions in the longitudinal direction, for allowing the end supporting members 55A and 55B to be attached thereto. Each attachment surface portion 546 is a flat portion that has none of the receiving portion 544 of the heating member 53, the upstream protrusion 61, the downstream protrusion 62, and the gap forming portion 71.

As illustrated in FIG. 3, the end supporting members 55A and 55B in the fixing belt unit 51 are members each including a support body 551 and a position restricting portion 552. The support body 551 has an arc-shaped support surface that is fitted inside from the corresponding one of both end portions 52*a* and 52*b* of the fixing belt 52 to rotatably guide and support the inner peripheral surface end portion of the fixing belt 52. The position restricting portion 552 protrudes from the support surface to restrict the position of the corresponding one of both end portions 52*a* and 52*b* of the fixing belt 52 at the outside of the support body 551.

As illustrated in FIG. 3, each of the end supporting members 55A and 55B has a cut 553, cut into a portion of the position restricting portion 552 adjacent to the pressing roller 59. The cut 553 is fitted to the attachment surface portion 546 (FIG. 4) of the guide holding member 54 to be fixed to the guide holding member 54.

In the fixing device 5, a lubricant 8 is applied to the inner peripheral surface of the fixing belt 52 to reduce the frictional resistance between the inner peripheral surface of the fixing belt 52 and the components (such as the heating member 53) that come into contact with and pass over the inner peripheral surface of the fixing belt 52.

The lubricant 8 is, for example, applied in advance to the inner peripheral surface of the fixing belt 52. Examples of the lubricant 8 include lubricant oil that is viscous liquid at room temperature and grease that is solid at room temperature.

Operation of Fixing Device

As illustrated in FIG. 2 or FIG. 3, in the fixing device 5, when the pressing roller 59 is brought into pressure contact with the heating member 53 with the fixing belt 52 of the fixing belt unit 51 interposed therebetween at a predetermined pressing force F, the above-described image fixing portion (fixing nip) FN is formed between the pressing roller 59 and the outer peripheral surface of the fixing belt 52.

When the elastic layer 592 of the pressing roller 59 is elastically deformed after the pressing roller 59 is brought into pressure contact with the plane heater of the heating member 53 with the fixing belt 52 interposed therebetween, the image fixing portion FN is formed as a relatively wide pressure contact area having a predetermined width in the rotation direction C of the fixing belt 52, besides the width direction D of the fixing belt 52. Thus, the fixing device 5 has highly efficient fixing ability.

At the timing where a fixing operation is to be performed, in the fixing device 5, the pressing roller 59 rotates at a predetermined speed in the direction indicated with arrow B, so that the fixing belt 52 of the fixing belt unit 51 is driven to rotate in the direction indicated with arrow C. At this time, in the fixing device 5, the heating member 53 in the fixing belt unit 51 starts heating the fixing belt 52 to a temperature appropriate for fixing while the fixing belt 52 is passing by the heating member 53.

Subsequently, when the fixing device 5 becomes ready for performing the fixing operation, as illustrated in FIG. 2, the recording sheet 9 to which the toner image T has been second-transferred is fed to the image fixing portion FN between the fixing belt unit 51 and the pressing roller 59. At this time, as described above, the fixing device 5 heats the recording sheet 9 and the toner image T with pressure while the recording sheet 9 is passing through the image fixing portion FN to melt the toner image T and fix the toner image T to the recording sheet 9.

In the fixing device 5, the fixing belt 52 rotates so as to pass through the image fixing portion FN while being pressed by the pressing roller 59 against the heating member 53 with the pressing force F. At this time, frictional resistance occurs between the heating member 53 and the inner peripheral surface of the fixing belt 52.

However, the fixing device 5 reduces the frictional resistance with the lubricant 8 applied to the inner peripheral surface of the fixing belt 52.

Thus, in the fixing device 5, the fixing belt 52 rotates while relatively smoothly passing through the image fixing portion FN, so that the fixing device 5 is capable of performing an efficient fixing operation.

Detailed Structure of Fixing Device

A fixing device 5A has the following structure in order to prevent the lubricant 8 from leaking out of the end portions 52*a* and 52*b* of the fixing belt 52 in the width direction D.

Figure 6A:
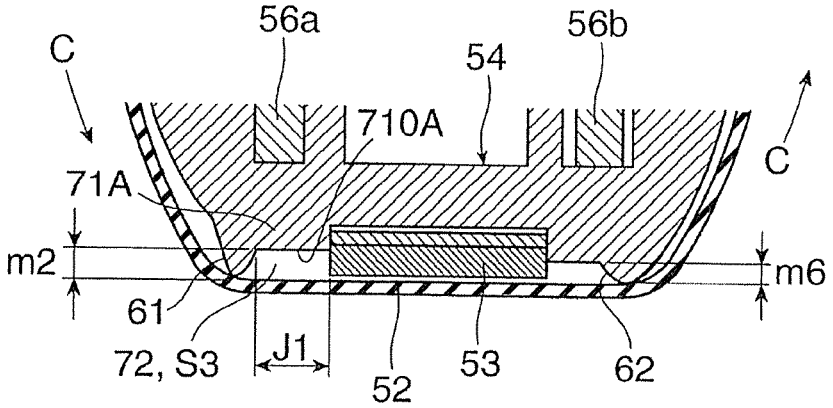
FIG. 6A is a schematic sectional view of a portion of the fixing device illustrated in FIG. 4 taken along line VIA-VIA.
Figure 6B:
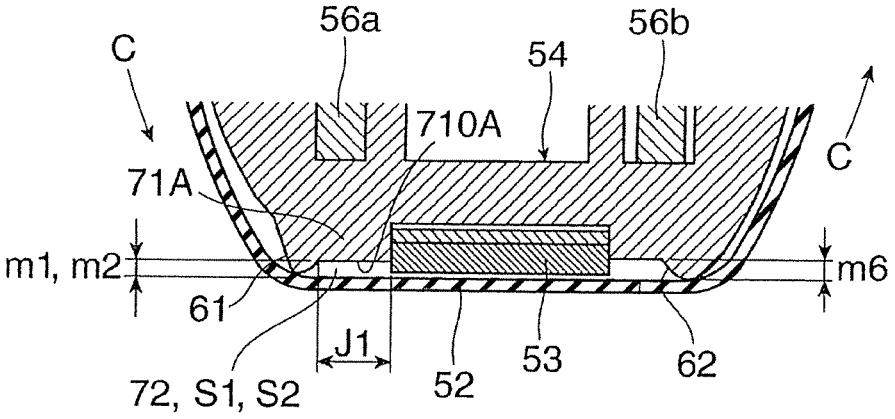
FIG. 6B is a schematic sectional view of a portion of the fixing device illustrated in FIG. 4 taken along line VIB-VIB.

Specifically, as illustrated in FIG. 5, FIG. 6A, and FIG. 6B, the fixing device 5A according to the first exemplary embodiment has a space defined by the fixing belt 52, the upstream protrusion 61, the gap forming portion 71, and the heating member 53 (the space corresponding to a space of the gap 72 defined by the gap forming portion 71). The space has a vertically sectional area S that is larger at a center portion than at end portions in the width direction D of the fixing belt 52.

Here, the vertically sectional area S refers to the sectional area of the space 72 taken along the plane perpendicular to the direction parallel to the width direction D of the fixing belt 52. Portions adjacent to the end portions in the width direction D of the fixing belt 52 are referred to as the areas corresponding to the end portions 52*a* and 52*b* of the fixing belt 52 or the areas (sheet passage areas) extending from the end portions 52*a* and 52*b* to the end portions of the area over which the recording sheet 9 having the maximum width passes. The center portion of the fixing belt 52 is referred to as an inner portion excluding the areas of the end portions.

Specifically, the space 72 in the fixing device 5A is formed by forming the gap forming portion 71 as a gap forming portion 71A having a center portion having a distance m from the inner peripheral surface of the fixing belt 52 longer than that at the end portions in the width direction D of the fixing belt 52.

As illustrated in FIG. 5, the gap forming portion 71A here has, as an opposing surface 710A that opposes the inner peripheral surface of the fixing belt 52, an opposing surface that is a curved surface having distance m from the inner peripheral surface of the fixing belt 52 gradually increasing as the curved surface extends toward the center position P3 in the width direction D of the fixing belt 52 from the positions P1 and P2 slightly inward than the positions corresponding to the end portions 52*a* and 52*b* of the fixing belt 52. On the other hand, a dimension J (FIG. 4) of the opposing surface 710A in the rotation direction C of the fixing belt 52 between the upstream protrusion 61 and the heating member 53 is a uniform dimension J1 (FIGS. 6A and 6B) throughout in the width direction D of the fixing belt 52.

As illustrated in FIG. 5, the gap forming portion 71A forms a gap 72 (space of the gap 72). In the gap 72, the distance m by which the opposing surface 710A is spaced apart from the inner peripheral surface of the fixing belt 52 has a relationship where the distances m2, m3, and m4 in the center portion areas are greater than the distance m1 in the areas near the end portions 52*a* and 52*b* in the width direction D of the fixing belt 52.

Here, the distance m1 is a value at the positions P1 and P2 near the end portions of the opposing surface 710A. The distance m2 is a value at the center position P3 of the opposing surface 710A. The distances m3 and m4 are values at substantially middle positions between the center position P3 and the positions P1 and P2 near the end portions. These values satisfy the relationship of m2>m3 (or m4).

The reference sign m6 in FIGS. 6A and 6B denotes the distance by which the opposing surface 710A is spaced apart from the inner peripheral surface of the fixing belt 52 in the gap 72 formed between the heating member 53 and the downstream protrusion 62. The distance m6 is uniform throughout in the width direction D of the fixing belt 52.

As illustrated in FIGS. 6A and 6B, in the fixing device 5A, the vertically sectional area S3 in the center portion area of the space 72 is greater than the vertically sectional area S1 (or S2) in the end portion areas. Specifically, S3>S1 (or S2) is satisfied.

The distance m gradually increases toward the center position P3 provided that the dimension J of the opposing surface 710A is uniform (at J1). Thus, the vertically sectional area S3 in the center portion area of the space 72 in the fixing device 5A is gradually increased toward the center position P3 of the opposing surface 710A from the positions P1 and P2 near the end portions. Actually, the vertically sectional area S is maximum at the center position P3 at which the distance m (m2) is maximum.

The vertically sectional area S of the space 72 in the fixing device 5A satisfies the relationship corresponding to the relationship of the distance m by which the opposing surface 710A is spaced apart from the inner peripheral surface of the fixing belt 52. Specifically, the vertically sectional area S increases as the distance m increases.

The following method is usable as an example of a method for verifying (inspecting) the size of the vertically sectional area S of the space 72. Specifically, the method is to calculate the vertically sectional area S by measuring the positions of portions forming the wall surfaces of the gap (space) 72 in the fixing device 5A. More specifically, for example, the dimension of the fixing belt 52 defining the gap 72 in the rotation direction C (stretch direction) and the shape of the gap forming portion 71 are measured by observation using an optical microscope or measured directly with a measuring device such as a ruler to acquire the distance m. The distance m in the transport direction of the recording sheet 9 is measured at multiple positions to calculate the vertically sectional area S through integration.

In the fixing device 5A, when the lubricant 8 applied to the inner peripheral surface of the fixing belt 52 stays in the gap 72 (or the above-described space) defined by the gap forming portion 71A, the lubricant 8 moves toward an area in the gap (space) 72 having a larger vertically sectional area S.

Particularly, in the fixing device 5A, the fixing belt 52 passes through the image fixing portion FN while being pressed by the pressing roller 59 against the heating member 53. Thus, part of the lubricant 8 adhering to the inner peripheral surface of the fixing belt 52 is more likely to be removed from the inner peripheral surface and accumulated in the gap (space) 72.

Figure 7:
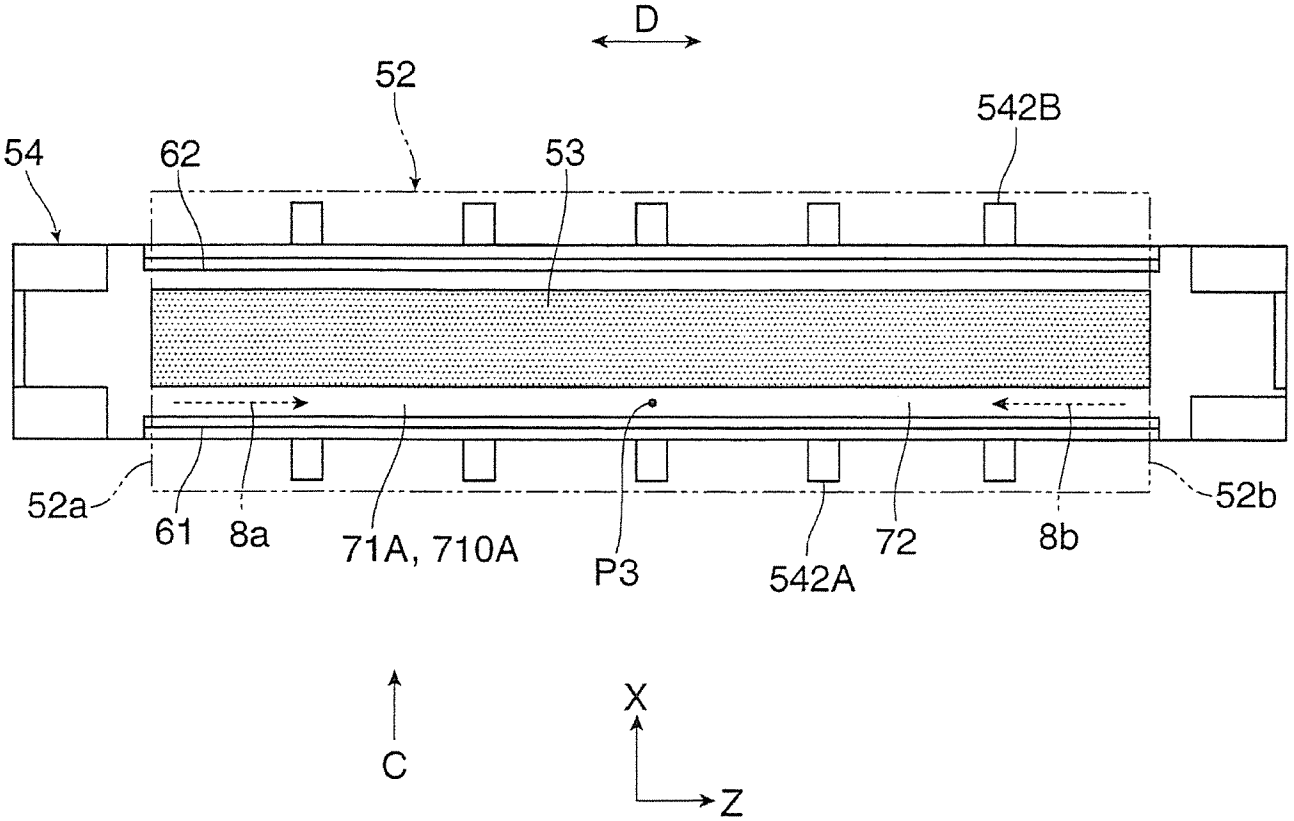
FIG. 7 is a schematic view of an effect of a portion of the fixing device illustrated in FIG. 2.

Consequently, in the fixing device 5A, as exemplarily illustrated in FIG. 7, lubricant portions 8*a* and 8*b* staying in the end portion areas in the width direction D of the fixing belt 52 in the gap 72 defined by the gap forming portion 71A move toward the center portion area in the gap (space) 72 having a larger vertically sectional area S. At this time, the lubricant 8 moves regardless of the position of the gap 72 with respect to the direction of gravity.

In the fixing device 5A, the lubricant 8 moves toward the center portion area from the end portion areas in the width direction D of the fixing belt 52 in the gap 72 defined by the gap forming portion 71A. Thus, part of the lubricant 8 is prevented from leaking out of the end portions 52*a* and 52*b* of the fixing belt 52. The fixing device 5A thus prevents defects such as a rise of torque due to the rotation of the pressing roller 59 caused when part of the lubricant 8 leaks out of the end portions 52*a* and 52*b* of the fixing belt 52 or erroneous rotation of the fixing belt 52.

In the image forming apparatus 1 including the fixing device 5A, the lubricant 8 is prevented from leaking out of the end portions 52*a* and 52*b* of the fixing belt 52 of the fixing device 5A, so that defects such as the image quality errors attributable to the leakage of the lubricant (degradation of the image quality due to fixing errors or adhesion of the lubricant to the recording sheet 9) are prevented.

The movement of the lubricant 8 in the gap 72 is assumed to be caused by, for example, the effect of capillary action.

Specifically, capillary action is generally known as a relationship of a liquid where the liquid has a greater force to flow (move) as it has a greater surface area. The gap (space) 72 is also said as having a relationship where the surface area in the vertically sectional area S of the gap 72 increases as the vertically sectional area S increases relatively. Thus, the lubricant 8, which is an example of liquid in the gap (space) 72, is also believed to move toward the area of the gap (space) 72 having a greater vertically sectional area S. This holds true to the movement of the lubricant 8 in the fixing device according to any of the subsequent exemplary embodiments.

Second Exemplary Embodiment

Figure 8:
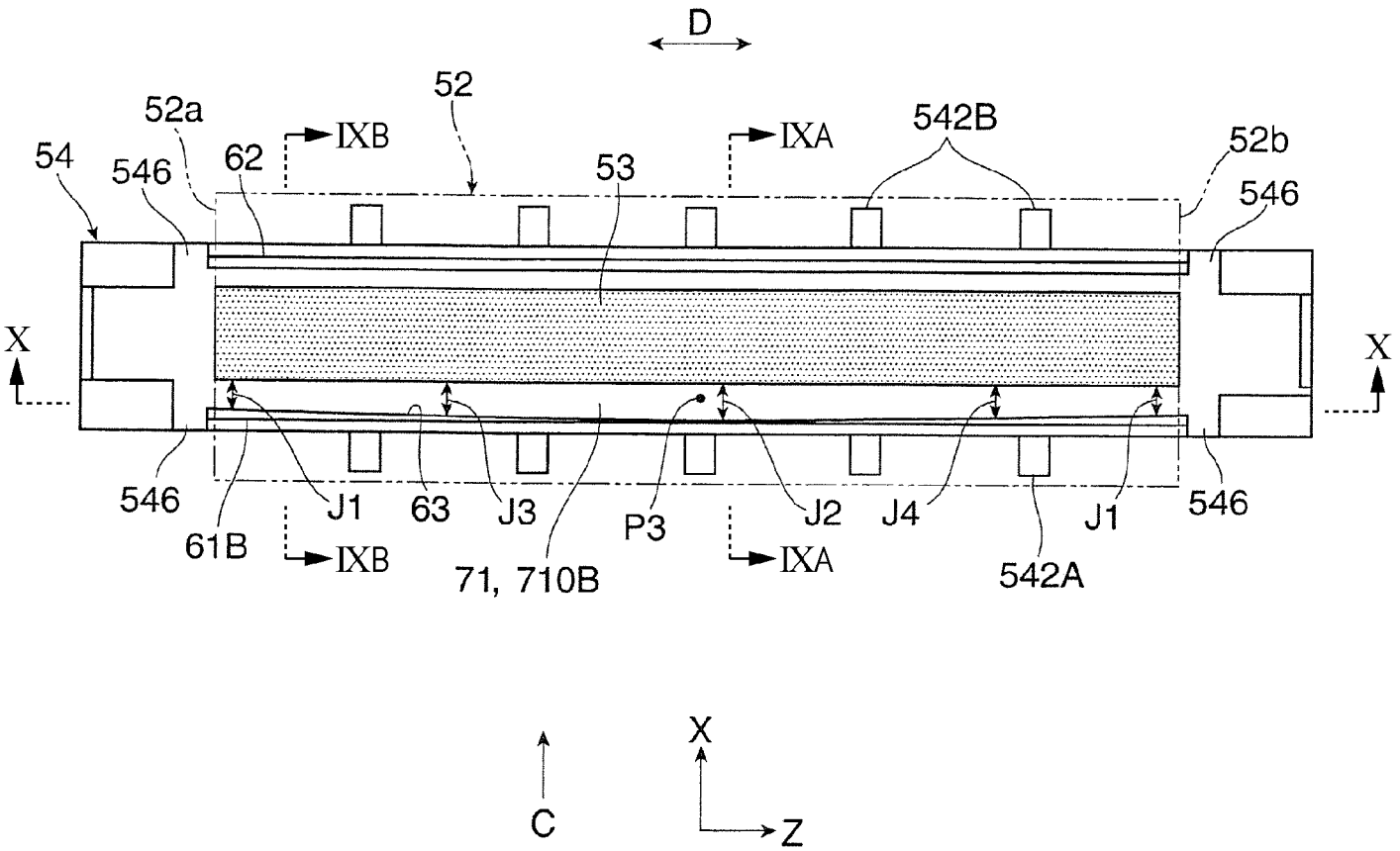
FIG. 8 is a schematic diagram of the structure of a portion (portion excluding a pressing roller viewed from the side on which the pressing roller is to be disposed) of a fixing device according to a second exemplary embodiment.
Figure 9A:
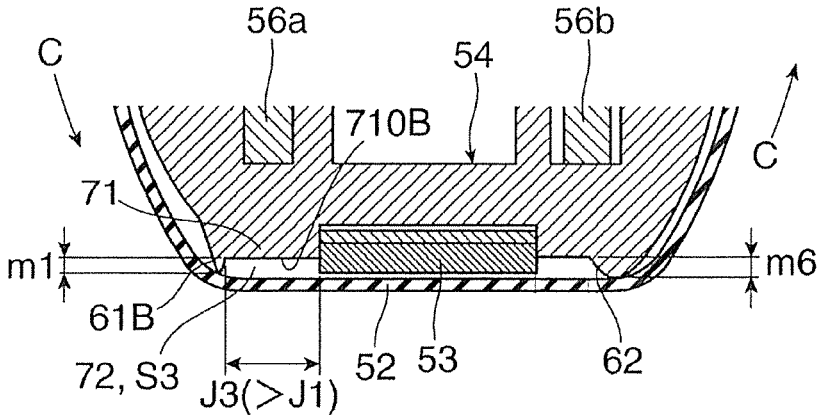
FIG. 9A is a schematic sectional view of a portion of the fixing device illustrated in FIG. 8 taken along line IXA-IXA.
Figure 9B:
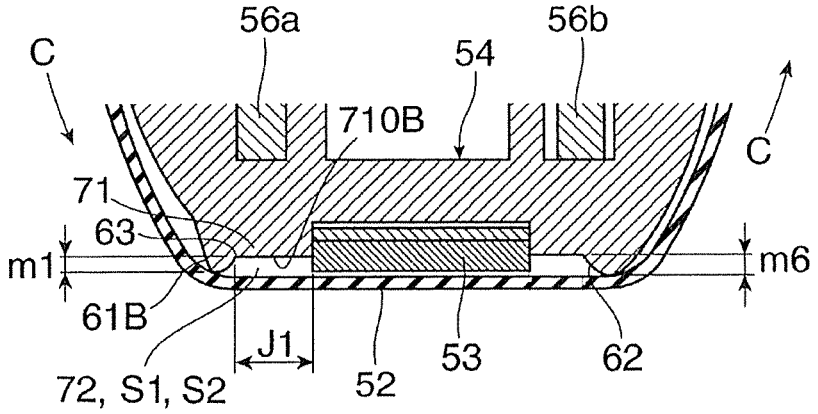
FIG. 9B is a schematic sectional view of a portion of the fixing device illustrated in FIG. 8 taken along line IXB-IXB.

FIG. 8, FIG. 9A, and FIG. 9B illustrate related portions of a fixing device according to a second exemplary embodiment.

A fixing device 5B according to a second exemplary embodiment has the same structure as the fixing device 5A according to the first exemplary embodiment (FIG. 2 and other drawings) except that the vertically sectional area S of the space (space in the gap 72) has another structure to have the center portion greater than the end portions in the width direction D of the fixing belt 52. The components of the fixing device 5B the same as those of the fixing device 5A are denoted with the same reference signs in FIG. 8 and the subsequent drawings, and thus are not generally described below.

As illustrated in FIG. 8, FIG. 9A, and FIG. 9B, the fixing device 5B has a space 72 defined by the fixing belt 52, the upstream protrusion 61, the gap forming portion 71, and the heating member 52. The upstream protrusion 61 is formed as an upstream protrusion 61B in which the dimension J by which a boundary portion (boundary line) 63 at the boundary with the gap forming portion 71 is spaced apart from the heating member 53 is greater at the center portion than at the end portions in the width direction D of the fixing belt 52.

As illustrated in FIG. 8, the upstream protrusion 61B curves so that the distance between the boundary portion 63 and the gap forming portion 71 gradually increases as the curve extends toward the center position P3 in the width direction D of the fixing belt 52 from the positions corresponding to the end portions 52*a* and 52*b* of the fixing belt 52.

Figure 10:
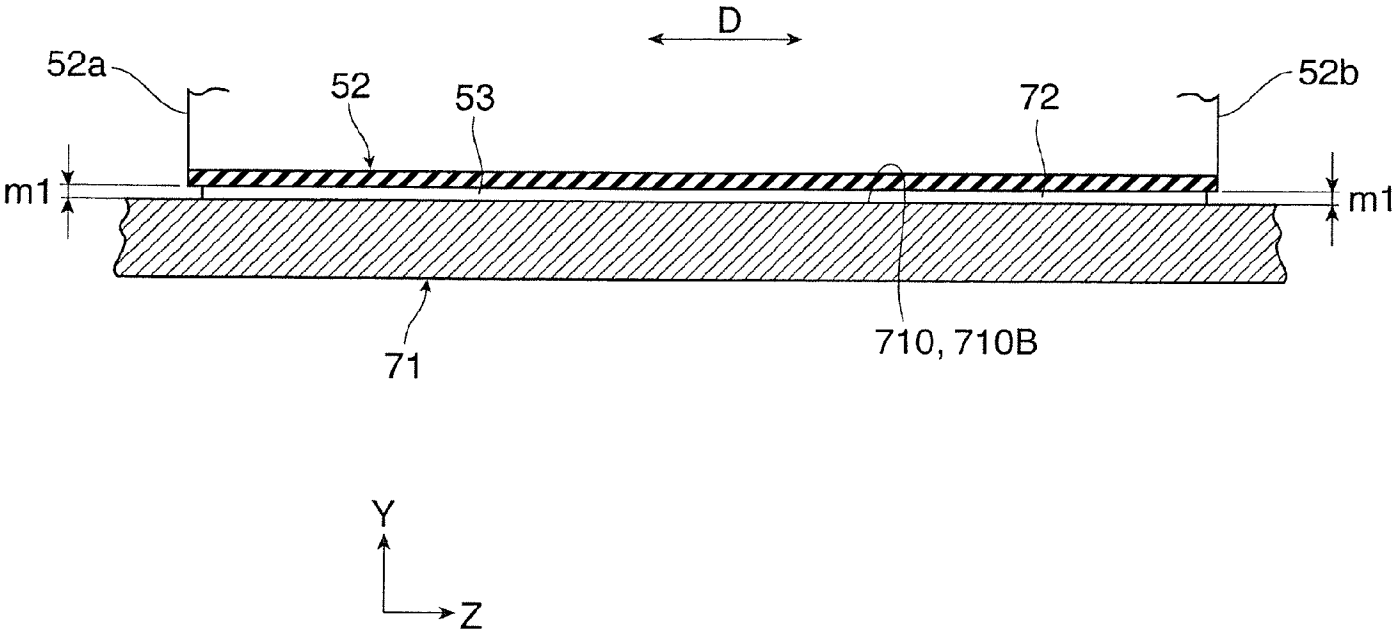
FIG. 10 is a schematic sectional diagram of a portion of the fixing device illustrated in FIG. 8 taken along line X-X.

When observed as the opposing surface 710 of the gap forming portion 71, employed as the opposing surface is an opposing surface 710B having the long side further from the heating member 53 curved to be gradually spaced apart, from the heating member 53, a longer distance as it extends toward the center position P3 in the width direction D of the fixing belt 52 from the positions corresponding to the end portions 52*a* and 52*b* of the fixing belt 52. As illustrated in FIG. 10, the opposing surface 710B here has a flat shape in which the distance m from the inner peripheral surface of the fixing belt 52 is a uniform value m1 throughout in the width direction D of the fixing belt 52.

As illustrated in FIG. 8, FIG. 9A, and FIG. 9B, the dimension J of the upstream protrusion 61B by which the boundary portion 63 is spaced from the heating member 53 has a relationship where the dimensions J2, J3, and J4 in the center portion area are greater than the dimension J1 in the areas of the end portions 52*a* and 52*b* in the width direction D of the fixing belt 52.

Here, the dimension J1 is a value at the positions near the ends of the opposing surface 710B slightly inward of the end portions 52*a* and 52*b* of the fixing belt. The dimension J2 is a value at the center position P3 of the opposing surface 710B. The dimensions J3 and J4 are values at substantially the middle between the center position P3 and the positions near the ends. These dimensions satisfy the relationship J2>J3 (or J4).

As illustrated in FIGS. 9A and 9B, in the fixing device 5B, the vertically sectional area S3 in the center portion area of the space 72 is greater than the vertically sectional area S1 (or S2) at the end portion areas. Specifically, S3>S1 (or S2) is satisfied.

The dimension J gradually increases toward the center position P3 provided that the distance m of the opposing surface 710B is uniform (at m1). Thus, the vertically sectional area S3 in the center portion area of the space 72 in the fixing device 5B is gradually increased toward the center position P3 from the end positions of the opposing surface 710B.

Specifically, the vertically sectional area S of the space 72 in the fixing device 5B has a relationship corresponding to the relationship of the dimension J of the upstream protrusion 61B from the heating member 53 of the boundary portion 63. Specifically, the vertically sectional area S relatively increases as the dimension J relatively increases.

In the fixing device 5B, when the lubricant 8 applied to the inner peripheral surface of the fixing belt 52 stays in the gap 72 (or in the above-described space) formed by the upstream protrusion 61B (and the gap forming portion 71), the lubricant 8 moves toward the area in which the vertically sectional area S in the gap (space) 72 relatively increases.

Figure 11:
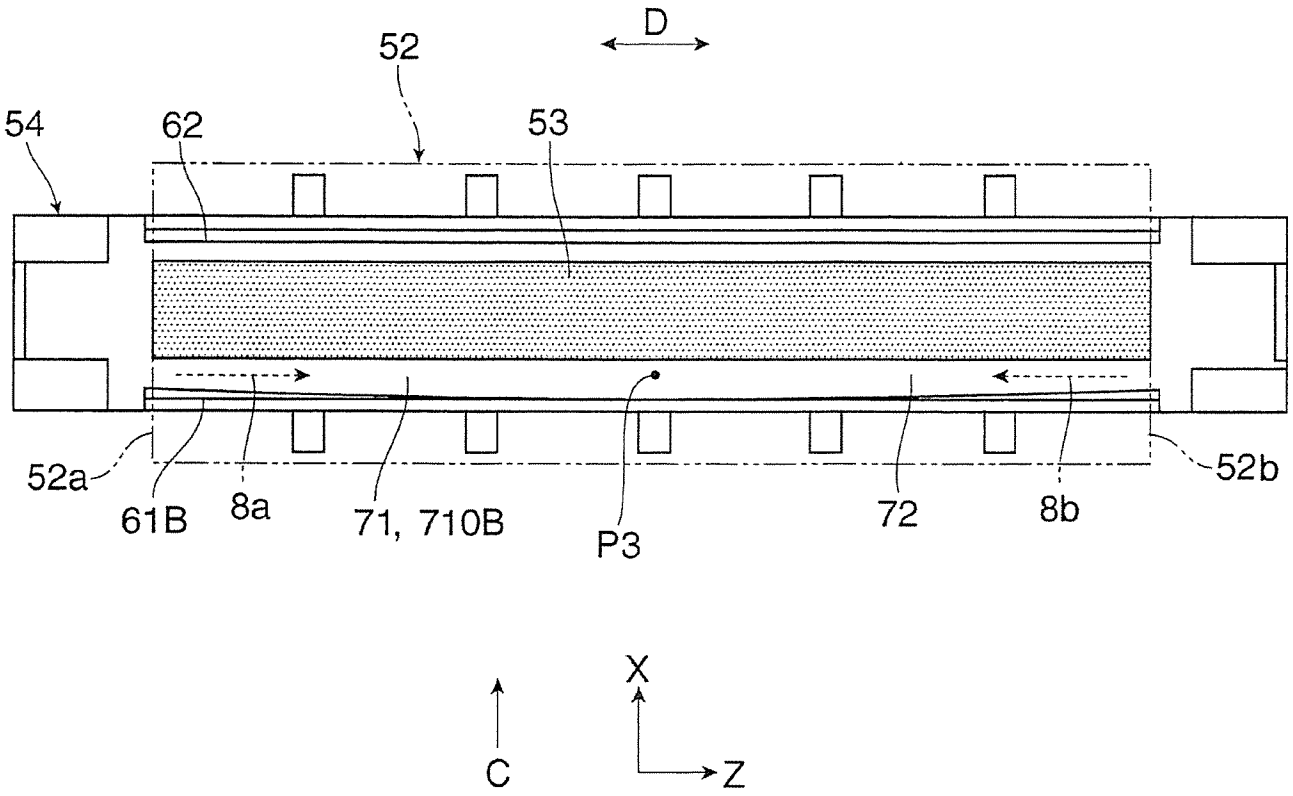
FIG. 11 is a schematic diagram illustrating effects of a portion of the fixing device illustrated in FIG. 8.

As exemplarily illustrated in FIG. 11, in the fixing device 5B, as in the case of the fixing device 5A according to the first exemplary embodiment, the lubricant portions 8*a* and 8*b* staying in the end portion areas, in the width direction D of the fixing belt 52, in the gap 72 defined by the upstream protrusion 61B and the gap forming portion 71 move toward the center portion area of the gap (space) 72 in which the vertically sectional area S relatively increases.

In the fixing device 5B, the lubricant 8 adhering to the inner peripheral surface of the fixing belt 52 moves toward the center portion area from the end portion areas in the width direction D of the fixing belt 52 in the gap 72 defined by the upstream protrusion 61B and the gap forming portion 71. Thus, part of the lubricant 8 is prevented from leaking out of the end portions 52*a* and 52*b* of the fixing belt 52.

As in the case of the image forming apparatus 1 according to the first exemplary embodiment including the fixing device 5A, the image forming apparatus 1 including the fixing device 5B thus prevents defects such as image quality degradation attributable to leakage of the lubricant from the end portions of the fixing belt 52 in the fixing device 5B.

Other Exemplary Embodiments

Figure 12:
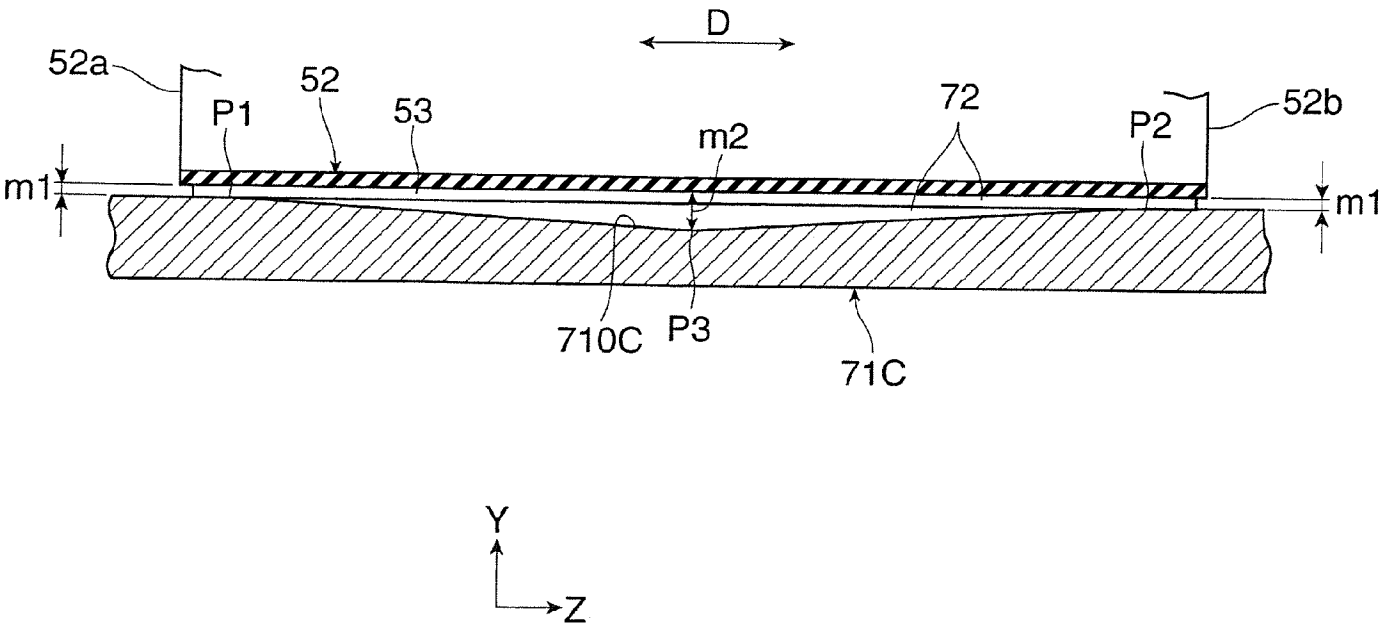
FIG. 12 is a schematic sectional diagram of another structure example of a gap forming portion of a fixing device.

Instead of the gap forming portion 71A of the guide holding member 54, the fixing device 5A according to the first exemplary embodiment may include, for example, a gap forming portion 71C exemplarily illustrated in FIG. 12.

The gap forming portion 71C has, as an opposing surface 710C that opposes the inner peripheral surface of the fixing belt 52, an opposing surface that is curved so that the distance m from the inner peripheral surface of the fixing belt 52 gradually increases as it extends toward the center position P3 in the width direction D of the fixing belt 52 from the positions P1 and P2 slightly inward of the positions corresponding to the end portions 52*a* and 52*b* of the fixing belt 52. Here, the curved surface is a combination of two flat surfaces extending from the positions P1 and P2 near the end portions to the center position P3 and joining at an angle at the center position P3 away from the inner peripheral surface of the fixing belt 52.

As illustrated in FIG. 12, the gap forming portion 71C also forms the gap 72 (space of the gap 72) in which the distance m of the opposing surface 710C from the inner peripheral surface of the fixing belt 52 has a relationship where the distance m2 at the center portion area is greater than the distance m1 at the areas near the end portions 52*a* and 52*b* in the width direction D of the fixing belt 52.

Instead of the upstream protrusion 61B (and the opposing surface 710B of the gap forming portion 71) of the guide holding member 54, the fixing device 5B according to the second exemplary embodiment may include a protrusion curved so that the distance by which the boundary portion 63 and the gap forming portion 71 are spaced apart from each other increases as the boundary portion 63 extends toward the center position P3 in the width direction D of the fixing belt 52 from the positions corresponding to the end portions 52*a* and 52*b* of the fixing belt 52.

Figure 13:
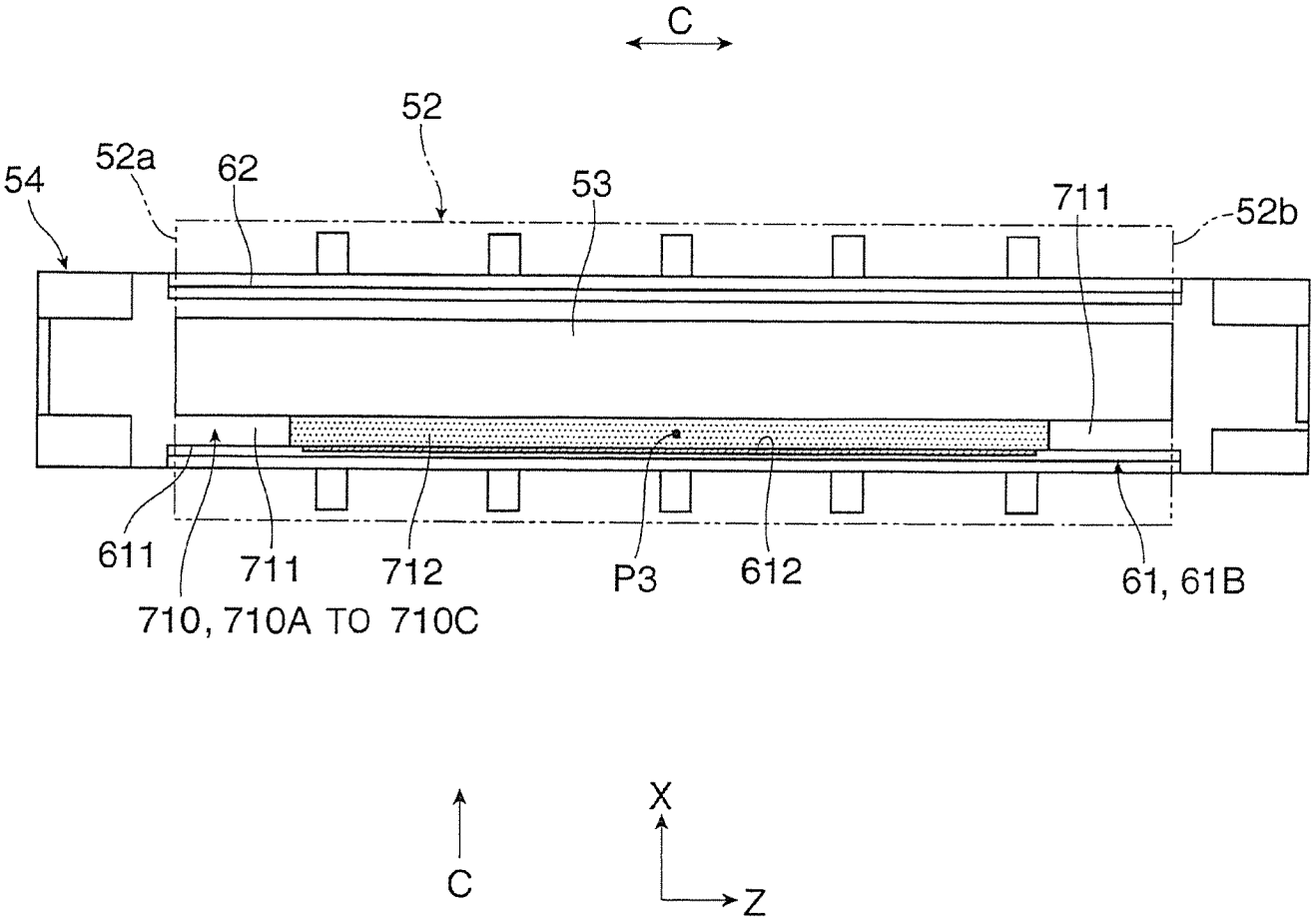
FIG. 13 is a schematic diagram of another structure example of a gap forming portion and an upstream protrusion of a fixing device.

In the fixing device 5A according to the first exemplary embodiment, as exemplarily illustrated in FIG. 13, the opposing surface 710A (FIG. 7) of the gap forming portion 71A in the guide holding member 54 may have its center portion area formed as a rough surface 712, which is rougher than the end portion areas.

Here, the rough surface 712 of the opposing surface 710A is a rough (uneven) surface having higher surface roughness than that of a surface 711 in the end portion areas. The rough surface 712 may be obtained by a method such as embossing. The rough surface 712 may have uniform surface roughness throughout. However, the rough surface 712 preferably has its surface roughness gradually increasing toward the center position P3 from the end portions in the width direction D of the fixing belt 52.

When the rough surface 712 serves as the center portion area of the opposing surface 710C of the gap forming portion 71C, the vertically sectional area S3 in the center portion area of the space 72 is further greater than the vertically sectional area S1 (or S2) in the end portion areas, as the employment of the rough surface increases the surface area when microscopically viewed. Specifically, the center portion area of the opposing surface 710A formed of the rough surface 712 has a greater surface area than that of the end portion areas when microscopically viewed.

Thus, the lubricant 8 applied to the inner peripheral surface of the fixing belt 52 moves further toward the center portion area from the end portion areas in the width direction D of the fixing belt 52 in the gap 72 defined by the gap forming portion 71C.

As exemplarily illustrated in FIG. 13, also in the fixing device 5B according to the second exemplary embodiment, the center portion area of the surface of the upstream protrusion 61B connected to the gap forming portion 71 may be formed as a rough surface 612, which is rougher than the end portion areas.

The rough surface 612 may have the same structure as the rough surface 712 in the gap forming portion 71C.

When the rough surface 612 serves as the center portion area of the surface of the upstream protrusion 61B, the vertically sectional area S3 in the center portion area of the space 72 is further greater than the vertically sectional area S1 (or S2) in the end portion areas by the degree corresponding to the rough surface.

Thus, also in this case, the lubricant 8 applied to the inner peripheral surface of the fixing belt 52 moves further toward the center portion area from the end portion areas in the width direction D of the fixing belt 52 in the gap 72 defined by the gap forming portion 71C and the upstream protrusion 61B having the rough surface 612.

The rough surface 712 may be formed at the opposing surface 710A of the gap forming portion 71A (FIG. 7) having a uniform distance m from the inner peripheral surface of the fixing belt 52.

The rough surface 612 may be formed at the surface corresponding to the upstream protrusion 61 (FIG. 4) having a uniform dimension J from the heating member 53.

Also in any of the above structures, the space 72 defined by the gap forming portion 71 having the rough surface 712 and the upstream protrusion 61 having the rough surface 612 has the vertically sectional area S greater at the center portion than at the end portions in the width direction D of the fixing belt 52.

In the fixing device 5, the guide holding member 54 may include both the gap forming portion 71A according to the first exemplary embodiment and the upstream protrusion 61B according to the second exemplary embodiment. In this structure, the lubricant 8 is more highly expected to move toward the center portion from the end portions of the fixing belt 52 in the gap 72 defined by the gap forming portion 71A and the upstream protrusion 61B.

Figure 14:
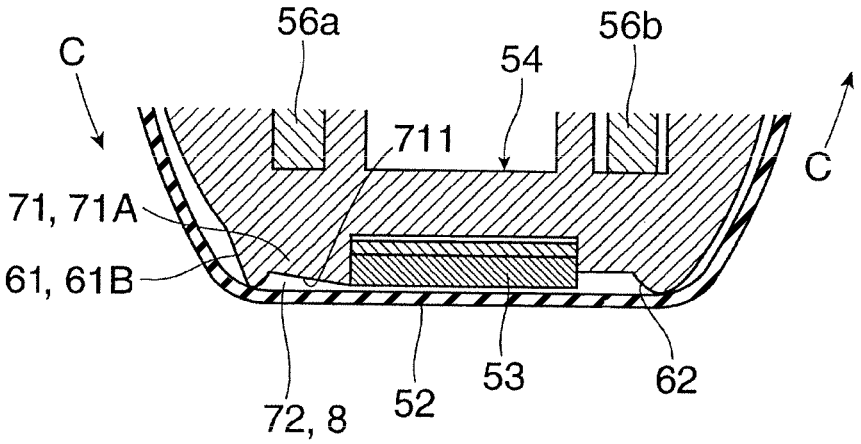
FIG. 14 is a schematic sectional diagram of another structure example of a gap forming portion of a fixing device.

The fixing device 5A according to the first exemplary embodiment and the fixing device 5B according to the second exemplary embodiment may include, as an opposing surface of the gap forming portion 71 (71A), an opposing surface 711 that has no step between itself and the heating member 53, as exemplarily illustrated in FIG. 14.

When the gap forming portion 71 (71A) including the opposing surface 711 is employed, the space 72 serves as a space defined by the gap forming portion 71 (71A), the upstream protrusion 61, and the fixing belt 52. The opposing surface 711 thus employed facilitates introduction of the lubricant 8 between the heating member 53 and the fixing belt 52 entering the image fixing portion FN.

Even when the gap forming portion 71 including the opposing surface 711 is employed, as described above in each exemplary embodiment, the space 72 is formed to have the vertically sectional area S greater at the center portion than at the end portions in the width direction D of the fixing belt 52.

In addition, the fixing device 5 (5A or 5B) may have the following structure, for example.

For example, instead of being held at a portion (receiving portion 544) of the guide holding member 54, the heating member 53 of the fixing belt unit 51 may be held by another member, for example, a support member dedicated for the heating member 53 or may be held by being directly attached to a portion of the housing 50.

Instead of the heating member 53, a pressure contact member (such as a pad member) may be used as the contact portion that comes into contact with the inner peripheral surface of the fixing belt 52 of the fixing belt unit 51 at the image fixing portion FN. When this pressure contact member is used, a belt that is heated by induction heating or a belt that is heated by a heater disposed at a portion other than the image fixing portion FN may be used as an example of the fixing belt 52.

A holding member not including the downstream protrusion 62 may be used instead, as an example of the guide holding member 54 of the fixing belt unit 51.

The lubricant 8 may be applied to the inner peripheral surface of the fixing belt 52 by, for example, a lubricant feeder that comes into contact with the inner peripheral surface of the fixing belt 52 to feed the lubricant 8 to the inner peripheral surface. Examples usable as the lubricant feeder include a member formed from nonwoven fabric or felt made of heat-resistant fiber impregnated with a lubricant and a roller member formed by winding a porous fluororesin film around the surface of a heat-resistant sponge roller holding a lubricant.

Instead of the pressing roller 59, a belt-shaped pressing device may be used as an example of the pressing unit.

An image forming apparatus including a fixing device according to an aspect of the present invention is not limited to the image forming apparatus that forms color images illustrated in, for example, the first exemplary embodiment.

The image forming apparatus may be, for example, an image forming apparatus that forms color images in another form or an image forming apparatus that forms single-color images (such as monochrome images).

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A fixing device, comprising:

a rotatable fixing belt;

a contact portion that comes into contact with an inner peripheral surface of the fixing belt in a width direction;

a holding portion, having a body shaped in a particular shape, and disposed opposite the inner peripheral surface of the fixing belt to guide and hold the fixing belt;

a pressing unit that presses the fixing belt against the contact portion;

a protrusion disposed at a portion of the holding portion upstream of the contact portion in a rotation direction of the fixing belt to come into contact with the inner peripheral surface of the fixing belt in the width direction;

a recess that forms a gap at a portion of the holding portion between the protrusion and the contact portion, the gap extending in the width direction of the fixing belt without allowing the fixing belt to come into contact with the holding portion; and a lubricant applied to the inner peripheral surface of the fixing belt, wherein a space defined by at least the fixing belt, the protrusion, and the recess has a vertical sectional area greater at a center portion than at an end portion in the width direction of the fixing belt.

2. The fixing device according to claim 1, wherein, in the space, a distance from the recess to the inner peripheral surface of the fixing belt is longer at the center portion than at the end portion in the width direction of the fixing belt.

3. The fixing device according to claim 2, wherein a center portion of the recess is formed from a rough surface that is rougher than an end portion of the recess.

4. The fixing device according to claim 3, wherein the contact portion protrudes beyond the recess toward the inner peripheral surface of the fixing belt, and wherein the space is a space defined by the fixing belt, the protrusion, the gap forming portion, and the contact portion.

5. The fixing device according to claim 2, wherein the contact portion protrudes beyond the recess toward the inner peripheral surface of the fixing belt, and wherein the space is a space defined by the fixing belt, the protrusion, the recess, and the contact portion.

6. The fixing device according to claim 1, wherein, in the space, a distance from the protrusion to the contact portion at a boundary between the protrusion and the recess is longer at the center portion than at the end portion in the width direction of the fixing belt.

7. The fixing device according to claim 6, wherein a center portion of the protrusion is formed from a rough surface that is rougher than an end portion of the protrusion.

8. The fixing device according to claim 6, wherein the contact portion protrudes beyond the recess toward the inner peripheral surface of the fixing belt, and wherein the space is a space defined by the fixing belt, the protrusion, the recess, and the contact portion.

9. The fixing device according to claim 7, wherein the contact portion protrudes beyond the recess toward the inner peripheral surface of the fixing belt, and wherein the space is a space defined by the fixing belt, the protrusion, the recess, and the contact portion.

10. The fixing device according to claim 1, wherein the contact portion protrudes beyond the recess toward the inner peripheral surface of the fixing belt, and wherein the space is a space defined by the fixing belt, the protrusion, the recess, and the contact portion.

11. An image forming apparatus, comprising a fixing device that fixes an unfixed image to a recording medium, wherein the fixing device is the fixing device according to claim 1.

12. A fixing device, comprising:

a rotatable fixing belt;

contact means for coming into contact with an inner peripheral surface of the fixing belt in a width direction;

holding means, disposed opposite the inner peripheral surface of the fixing belt, for guiding and holding the fixing belt;

pressing means for pressing the fixing belt against the contact means;

a protrusion disposed at a portion of the holding means upstream of the contact means in a rotation direction of the fixing belt to come into contact with the inner peripheral surface of the fixing belt in the width direction;

gap forming means for forming a gap at a portion of the holding means between the protrusion and the contact means, the gap extending in the width direction of the fixing belt without allowing the fixing belt to come into contact with the holding means; and a lubricant applied to the inner peripheral surface of the fixing belt, wherein a space defined by at least the fixing belt, the protrusion, and the gap forming means has a vertical sectional area greater at a center portion than at an end portion in the width direction of the fixing belt.

* * * * *